US008371964B2

(12) United States Patent
Jones et al.

(10) Patent No.: US 8,371,964 B2
(45) Date of Patent: Feb. 12, 2013

(54) VOLLEYBALL SPIKING TRAINING DEVICE

(75) Inventors: Jason Nathaniel Jones, Little Rock, AR (US); Thomas Michael Snoddy, Little Rock, AR (US)

(73) Assignee: Acu-Pac, Inc., Benton, AR (US)

( * ) Notice: Subject to any disclaimer, the term of this patent is extended or adjusted under 35 U.S.C. 154(b) by 223 days.

(21) Appl. No.: 12/928,879

(22) Filed: Dec. 22, 2010

(65) Prior Publication Data

US 2012/0165134 A1 Jun. 28, 2012

(51) Int. Cl.
*A63B 69/00* (2006.01)
*A63B 67/00* (2006.01)

(52) U.S. Cl. ..... 473/462; 473/422; 473/459; 473/473

(58) Field of Classification Search ..... 473/422, 473/459, 473, 451; 124/1, 7, 16, 36, 50, 124/51.1, 54; 434/247
See application file for complete search history.

(56) References Cited

U.S. PATENT DOCUMENTS

| | | | | |
|---|---|---|---|---|
| 2,939,705 | A | 6/1960 | McCall, Jr. | |
| 3,439,916 | A | 4/1969 | Kopp | |
| 3,897,950 | A | 8/1975 | Keller | |
| 4,021,036 | A * | 5/1977 | Nelson et al. | 473/459 |
| 4,122,822 | A * | 10/1978 | Scheiwiller | 124/50 |
| 4,548,407 | A * | 10/1985 | Sato | 124/7 |
| 4,798,390 | A | 1/1989 | Dooley | |
| 5,060,946 | A | 10/1991 | Taylor | |
| 5,066,010 | A * | 11/1991 | Pingston | 473/451 |
| 5,097,985 | A * | 3/1992 | Jones | 124/48 |
| 5,238,251 | A | 8/1993 | Staka | |
| 5,415,150 | A * | 5/1995 | Dallas | 124/50 |
| 5,470,056 | A | 11/1995 | Dennesen | |
| 5,520,397 | A | 5/1996 | Thompson | |
| 5,660,395 | A | 8/1997 | Marshall | |
| 5,980,399 | A * | 11/1999 | Campbell et al. | 473/459 |
| 6,171,205 | B1 | 1/2001 | Hummel | |
| 6,616,555 | B2 * | 9/2003 | Bewley | 473/451 |
| 6,974,396 | B2 * | 12/2005 | Mauer et al. | 473/451 |
| 7,001,289 | B1 | 2/2006 | Polega | |
| 7,041,016 | B1 | 5/2006 | Omtvedt | |
| 7,393,290 | B2 | 7/2008 | Martin | |
| 8,042,531 | B2 * | 10/2011 | Mashburn | 473/451 |
| 2009/0137349 | A1 | 5/2009 | Alekseev | |
| 2010/0130312 | A1 | 5/2010 | Fuentes | |

* cited by examiner

*Primary Examiner* — Mitra Aryanpour
(74) *Attorney, Agent, or Firm* — Stephen D. Carver

(57) ABSTRACT

A volleyball spike training system comprises a ball holder and an optional net. The training holder comprises a wheeled chassis supporting a vertical stanchion projecting upwardly that supports a hopper and a ball feeding apparatus. The stanchion includes a crank system for vertically adjusting telescoped stanchion segments. Balls dropping from the hopper travel by gravity down an inclined ramp at the top of the frame towards a discharge throat. Balls travelling down the ramp are indexed by a Z-shaped lever that serially separates them. A pair of downwardly projecting hands, one fixed and one pivoted, receive dropping balls and temporarily hold them for shooting. The pivoting hand controls the indexing lever to jam successive balls when the device is loaded. When a ball is shot and removed from between the feed hands, another ball is freed by the indexing lever to automatically drop into a shooting position between the hands.

20 Claims, 18 Drawing Sheets

VOLLEYBALL SPIKING TRAINING DEVICE

BACKGROUND OF THE INVENTION

1. Field of the Invention

The present invention relates generally to volleyball training devices. More particularly, the present invention relates to training devices that store and serially feed volleyballs to a discharge position suitable for spiking of the ball. Known prior art is classified in U.S. Class 473, Subclasses 422, 449, 459, and 473.

2. Description of the Related Art

Participation in the sport of volleyball is rising substantially throughout the world. Volleyball teams including both male and female players have become increasingly popular both at the high school and college level, and volleyball is now an Olympic sport. Volleyball can be played with minimal equipment over playing surfaces varying from modern basketball courts with precision wooden floors, to beach areas with imprecise courts formed in the sand. Thus over recent years volleyball has experienced a significant growth in popularity, both as a spectator and as a participant sport.

A volleyball game involves a pair of teams separated by a net strung over a playing surface. Hitting, spiking, and serving the ball are some of the important aspects of the game. The game is begun when a player serves a ball over the net to the receiving team on the opposite side. The receiving team must react to the served ball, and prevent it from hitting the floor or ground. Normal rules provide three contacts to return the ball over the net. Typically, these three contacts will include a pass to the net area, a set to an attacker, and an attack, which usually consists of a spike across the net. The spiking player seeks to drive the ball over the net and unto the floor or ground in the opposing team's court area in order to score.

When a spiking play is developing, it can be apparent to the opposing team, necessitating formation of a defense. This makes the art of spiking even more difficult since the spiking player must not only coordinate his or her moves with that of the ball, but he or she must watch opposing players, analyze their defense, and properly spike the ball to avoid them.

Naturally, the opposing team will defend against the spike, usually by executing a block, where control of the ball is established. The block may be executed by one or more defending players depending on circumstances and strategy. The object of the block is to intercept and gain control of the ball before it hits the ground. If the defenders are successful, they will soon turn to offense and spike the ball towards their opponents.

Thus spiking proficiency is an important facet of volleyball. Rigorous practice is required for most players to develop spiking skills suitable for their level of play. Spiking requires a high level of skill and coordination of volleyball athletes. It is, therefore, desirable to provide means for practicing the spike shot in volleyball.

Spiking defense, on the other hand, involves one or more players jumping at the appropriate time and location, and presenting a barrier with their open hands and arms. If successful, the defense players cause a rebound at high velocity and unpredictable direction.

During practice, one or more volleyballs must be located above the top of the volleyball net proximate the player's side of the net. The volleyball spiker typically jumps up, and then vigorously hits the ball downwardly at angle, aiming within the boundary lines of the volleyball court. The spike is a particularly effective shot in volleyball. The skilled volleyball athlete is able to direct the spiked ball in a desired direction and at a fast rate of speed. Because of this, defending a spike is not easy. Skilled spiking is, therefore, a favored attribute of volleyball athletes.

Spiking is one of the most interesting facets of volleyball, and one of the most difficult tasks to master. It involves more required coordination on the part of the spiking player than any other play in the sport and consequently, is more difficult than any other volleyball play. Successful spiking requires that the ball be set, that is, lofted by a companion player into position such that it begins its descending arc almost vertically and in a position adjacent to the net that is not readily accessible to defensive players.

Various volleyball training devices have been proposed for spiking practice. Training apparatuses have been developed to support a game ball at selected elevations for practice hitting. Simple spiking training devices may involve a frame or projection which is hand-held by one player that holds an elevated ball for striking by a companion player. For example, U.S. Pat. No. 5,660,395 issued Aug. 26, 1997 discloses a hand-held volleyball device for practicing spiking. The device manually positions a volleyball at a desired elevation above a playing surface so a training player can hit an elevated ball. The device comprises a generally C-shaped head and a support pole attached to the head grasped by an assistant or trainer. The head releasably retains a volleyball for subsequent impact and travel. After each shot the device must be manually reloaded.

The art also includes stationary, ground or floor mounted holders that temporarily secure a ball for player impact. Some of these devices simply clamp the ball between a pair of hands or holders that are biased together. These devices must also be manually reloaded after each practice shot. For example, U.S. Pat. No. 3,439,916 discloses a floor-supported training device that positions a football between a pair of biased arms for practice kicking. A football is manually positioned between the support arms at a selected height above a base where it is releasably held. A similar ball holding arrangement is seen in the volleyball spiking practice device illustrated in U.S. Pat. No. 3,897,950 issued Aug. 5, 1975. The latter device elevates practice volleyballs at selected elevations near a volleyball net with an elevated stanchion supporting a pair of arms that compressively secure the volleyball temporarily.

Volleyball training devices also include apparatus that is mounted directly upon or proximate the net. For example, U.S. Pat. No. 5,470,056 issued Nov. 28, 1995 discloses a practice device comprising an auxiliary net secured proximate a game net to impede the movement of a ball. The frame includes a top member and two side members, and one end of each of the two side members is attached to the top of a game net such that a target area at which the moving ball can be directed is defined by the frame and the top of the game net. Similarly, U.S. Pat. No. 6,171,205 issued Jan. 9, 2001 discloses volleyball training device comprising a frame removably fastened to the volleyball net, and a pedestal extending upwardly from the frame for holding a volleyball above the net.

Some spike training devices tether a single ball or multiple balls. Tethered balls return to a practice position after impact, and reloading is unnecessary. In such devices, a volleyball is tethered to a tether line coupled to a rigid support. The ball is restricted in movement after being hit by the tether line. Tethered arrangements obviate the necessity of reloading after a practice shot. A problem is that tethers do not allow the ball to move along its natural flight path. Consequently the ultimate success or failure of the spiking shot is unknown.

Moreover, tether type devices can interfere with proper targeting of the ball, leading to diminished performance by the user.

An example of a tethered volleyball training device is provided by U.S. Pat. No. 5,060,946 issued Oct. 29, 1991, which discloses a volleyball training device that includes an adjustable stanchion rising upwardly from a lower base. A practice volleyball is connected to the terminal end of an elevated arm extending outwardly from the stanchion via a tether cord to provide a practice target. Similarly, U.S. Pat. No. 5,238,251 issued Aug. 24, 1993, discloses a volleyball training apparatus comprising a horizontally outwardly extending resilient arm that tether a ball. The latter device includes a telescoping stanchion supported by a wheeled base that is slidably adjustable. U.S. Pat. No. Application No. 2009/0137349 published May 28, 2009 illustrates another device with a "tethered" ball for practicing spiking. A frame supports a single target ball secured upon an elastically connected, displaceable arm. After ball impacts, the arm is deflected and then returns to its striking position.

Some training devices tether the volleyball on two sides. U.S. Pat. No. 7,041,016 issued May 9, 2006 shows a volleyball spiking training system where a single ball is secured by tethers on each side, and elevated by a stanchion over a net for practice Multiple balls are tethered by the training device seen in U.S. Pat. No. Application No. 2010/0130312, published May 27, 2010. The latter training device has a lower base supporting a vertical stanchion that holds a plurality of suspended balls that are tethered to upright supports. The tethered balls may be addressed by a player, and impacted balls return to their access position by gravity, being held by the tethers. Reloading is unnecessary.

We have discovered that it is advantageous to train spiking with an elevated ball feeding device that serially positions balls automatically in a "hit" position. Such devices need not be reloaded after each shot, and the ball trajectory derived during practice more closely resembles that of an actual spike. Some designs known in the art include a hopper communicating with a serial ball feeder, both of which are elevated over ground by a vertical pedestal or post. The vertical post may extend from a weighted base or support disposed on the playing surface proximate the net, which may or may not be wheeled.

A prior art design of the latter general natures is seen in U.S. Pat. No. 2,939,705 issued Jul. 12, 1957. The latter reference discloses a vertically upright basketball practice device that serially feeds basketballs. An adjustable stanchion extends vertically upwardly from a lower base. An inclined hopper atop the stanchion stores a plurality of basketballs that are gravity fed down an inclined ramp. Serially fed balls are temporarily stored one-at-a-time upon a ball receiving loop forming a discharge point. Serial feeding is controlled by a mechanical trip lever near the discharge point.

A similar design involving an inclined discharge chute is seen in U.S. Pat. No. 5,520,397 issued May 28, 1996. This upright volley ball practice apparatus gravity feeds balls from an upper storage hopper to a striking position via an inclined guideway or ramp. A triggering mechanism serially advances volleyballs from the hopper onto the inclined ramp, where they travel by gravity towards an impact position from which a player may spike the ball. Other devices including gravity feeding ramps are seen U.S. Pat. Nos. 4,798,390, 7,001,289, and 7,393,290.

Designs including elevated hoppers, gravity operated chutes, and elevated hoppers are as described above are preferred for rapid shooting, and training sessions involving multiple players making numerous, repetitive spike shots. However, the hoppers must be designed so as to hold numerous balls, while discharging them smoothly without jamming. Frames and supporting stanchions or pedestals must be easily adjusted to accommodate players of different sizes and ages. Importantly, the discharge ramp apparatus must function smoothly to establish an orderly flow of balls without interruption. In other words, the discharge apparatus and the required indexing arrangements must reliably establish a "one-at-a-time" serial flow of balls and flawlessly to prevent jamming and unwanted interruptions.

BRIEF SUMMARY OF THE INVENTION

Our preferred spike training system comprises a spike training device and an optional target net. The training device and the auxiliary net each are wheeled so that they can be quickly moved to a practice site. Once the training device is positioned, preferably proximate a conventional playing net, the chassis can be locked, and to keep from tipping over there is ballast container to add stabilizing weight. An elevated stanchion projects upwardly from the training device chassis to support the ball feeding components. The stanchion includes a crank system for vertically adjusting telescoped stanchion segments so that a proper playing height can be achieved.

The hopper atop the stanchion holds several volleyballs. The balls travel by gravity down an inclined ramp at the top of the frame leading from the hopper towards a discharge throat. As the balls travel down the ramp, they are indexed by a mechanical lever that separates the balls so that they enter a strike point one-at-a-time. A pair of downwardly projecting hands receive balls dropping from the ramp and temporarily hold them for shooting. In the best mode, one hand is fixed in position, and its companion is deflectable. A holding point from which balls may be manually struck by a player or trainee is thus established between the hands. Once a ball is stricken, and thus removed from its temporary position between the hands, the next sequential ball will be freed by the indexing lever, and the ball will automatically drop into position between the hands for subsequent spiking.

Thus a basic object of our invention is to provide a volleyball training and practice device.

Another basic object is to provide training device of the character described that is particularly adapted for training volleyball players to properly spike the ball.

It is also a primary object of this invention to provide an improved volleyball spiking training apparatus adapted to be placed anywhere upon the playing court, that can be easily adjusted to suit the training conditions.

Similarly, it is an object to provide an adjustable spike training device that accommodates players of different ages, heights, and levels of experience.

It is another important object of our invention to provide a spike practice device which allows a person to practice alone, and without constantly reloading the ball impact point.

It is another object of the invention to provide a reliable ball hopper and feeding apparatus for reliably feeding sports balls to a discharge point without jamming.

Another basic object of the present invention to train players in proper volleyball spiking techniques.

These and other objects and advantages of the present invention, along with features of novelty appurtenant thereto, will appear or become apparent in the course of the following descriptive sections.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
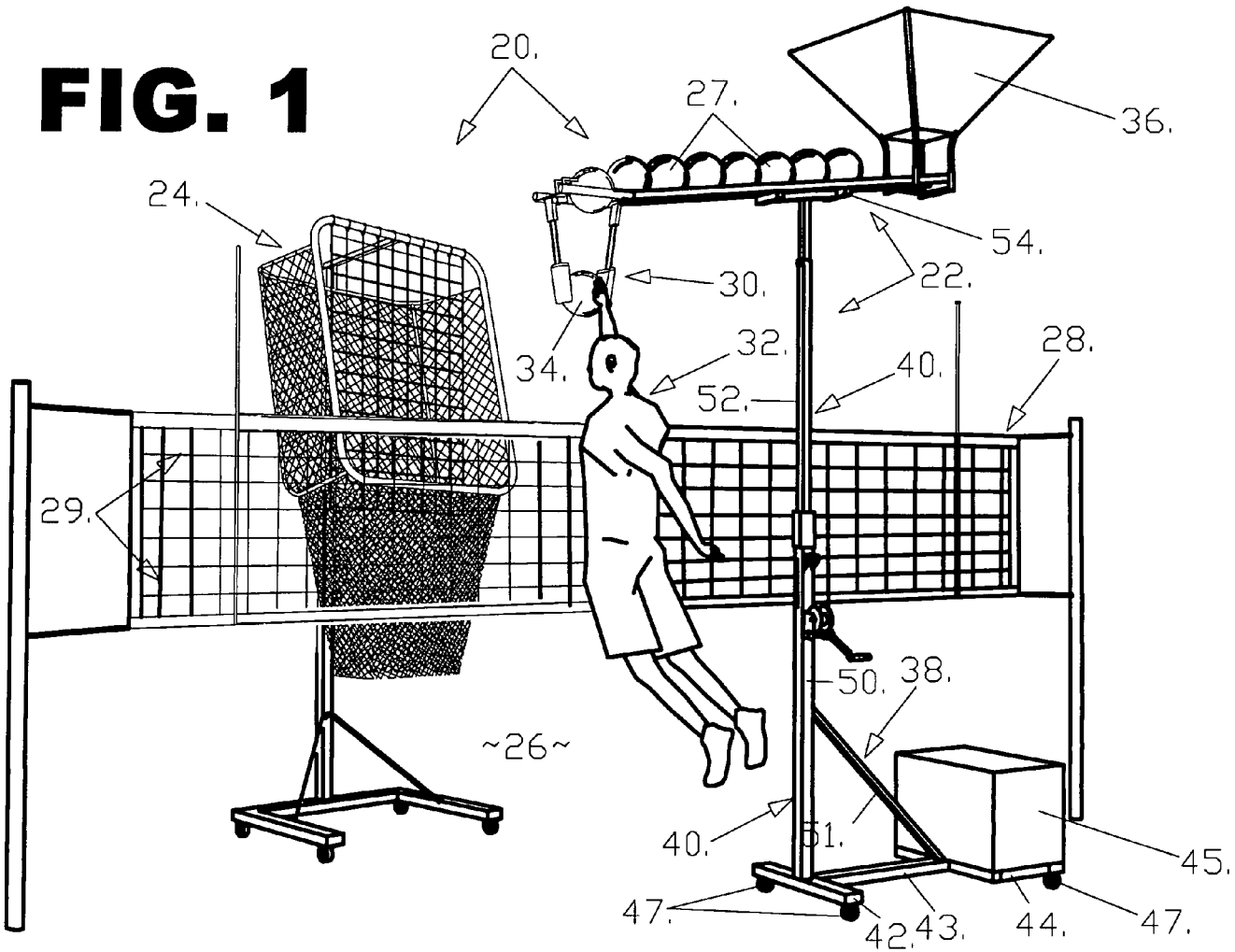
FIG. 1 is a fragmentary isometric view illustrating the best mode of our new volleyball training device, showing it in use proximate a volleyball net near an adjacent target.

With initial reference directed now to FIG. 1 of the appended drawings, our new Volleyball Spiking Training Device is illustrated as part of a volleyball training system 20. The training system includes our spiking training device 22, constructed generally in accordance with the best mode of the invention. The training device 22 is illustrated disposed upon a volleyball or basketball court 26 proximate a standard volleyball net 28 including webbing 29 suspended between standard support poles at its opposite ends. An auxiliary target net assembly 24 spaced upon the opposing court surface is preferable as an aiming point, and it collects shot balls as described hereinafter. The training device 22 receives and temporarily stores a plurality of playing balls 27 vertically above the playing surface 26. Balls are serially fed towards a discharge point generally indicated by the reference numeral 30, for spiking by a typical player or trainee 32. When a ball 34 is properly stricken by player 32, it will travel over net 28 towards a target point, such as auxiliary net assembly 24, or it will be directed onto the opposing court. As soon as ball 34 is stricken, a replacement ball will drop into place for a subsequent spike. Feeding is continuous and automatic, and does not require repetitive manual reloading of the discharge hands. Balls are periodically tossed into the hopper 36 atop training device 22, and they drop from the hoper onto the feed ramp below. The hopper act as a guide chute and processes one ball at a time.

With joint reference directed now to FIGS. 1, 2, 15, and 16 the practice device 22 preferably comprises a wheeled chassis 38 that supports a vertically upright stanchion 40 secured to lower horizontal strut 42. A lower companion strut 43 extends from strut 42 to a somewhat rectangular subframe 44 that mounts a ballast container 45, which is generally in the form of a parallelepiped. Container 45 is normally filled with weights appropriate to counterbalance and stabilize the training device 22. Caster wheels 47 secured to strut 42 and subframe 44 provide wheeled support for the training device 22 to provide mobility. As explained hereinafter, the vertically adjustable stanchion 40 supports the hopper 36, various playing balls 27, 34 and the feeding mechanism above the playing court 26 so that a proper training elevation suitable for player 32 is established.

The adjustable stanchion 40 comprises a rigid, elongated lower section 50 that is welded to chassis strut 42 and secured by chassis brace 51 (FIG. 1). The outer and lower hollow channel steel stanchion section 50 telescopingly receives an internal extension 52 that supports an upper I-shaped bracket 54 that in turn mounts the feeding and hopper assemblies. As best viewed in FIGS. 15 and 16, a manually cranked drive assembly 56 is secured to stanchion section 50 at a conveniently accessible height for elevation adjustments. The crank assembly 56 comprises a mounting bracket 58 that supports a rotatable spindle 60 that controls drive cable 62. Spindle 60 is turned by a manual crank handle 64 that is coupled to spindle 60 by suitable reduction gearing 66. Cable 62 is entrained about idler pulley 67 and enters stanchion section 50, with an end 69 terminating in a connection to the upper, internal telescoping stanchion section 52. A pair of slidable centering blocks 59 (FIG. 15) are affixed to the lower portion of internal stanchion section 52 for centering and alignment. A pair of resilient alignment pads 72 above idler pulley 67 are disposed within a enshrouding housing 74. The housing 74 for the guide material 72 is located at the top of the stanchion. The guide material 72 (FIG. 15) is preferably glued to housing 74, but could also be attached in other ways such as rivets.

Figure 2:
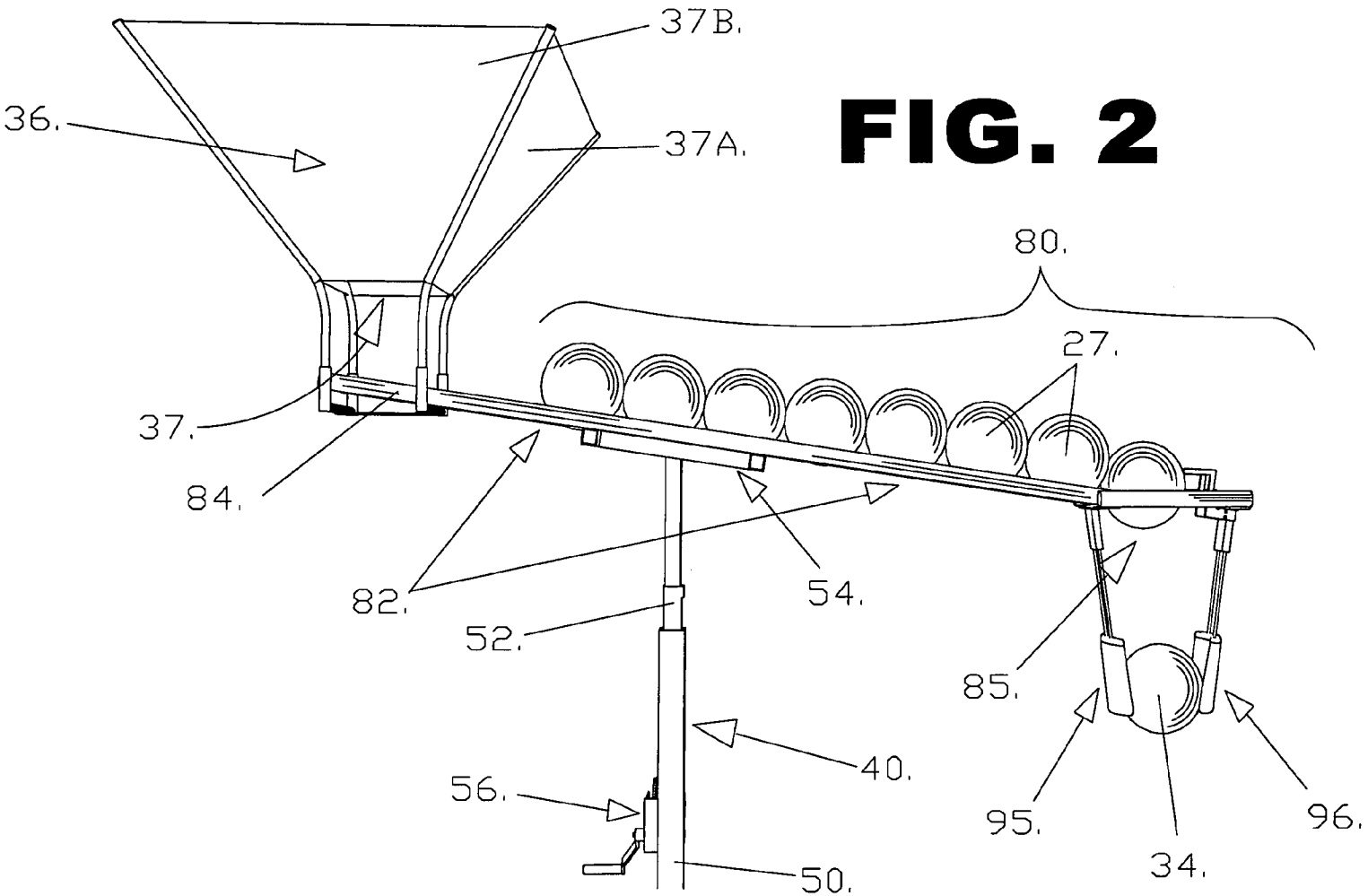
FIG. 2 is an enlarged, fragmentary, isometric view of the preferred ball hopper and feeding apparatus.
Figure 4:
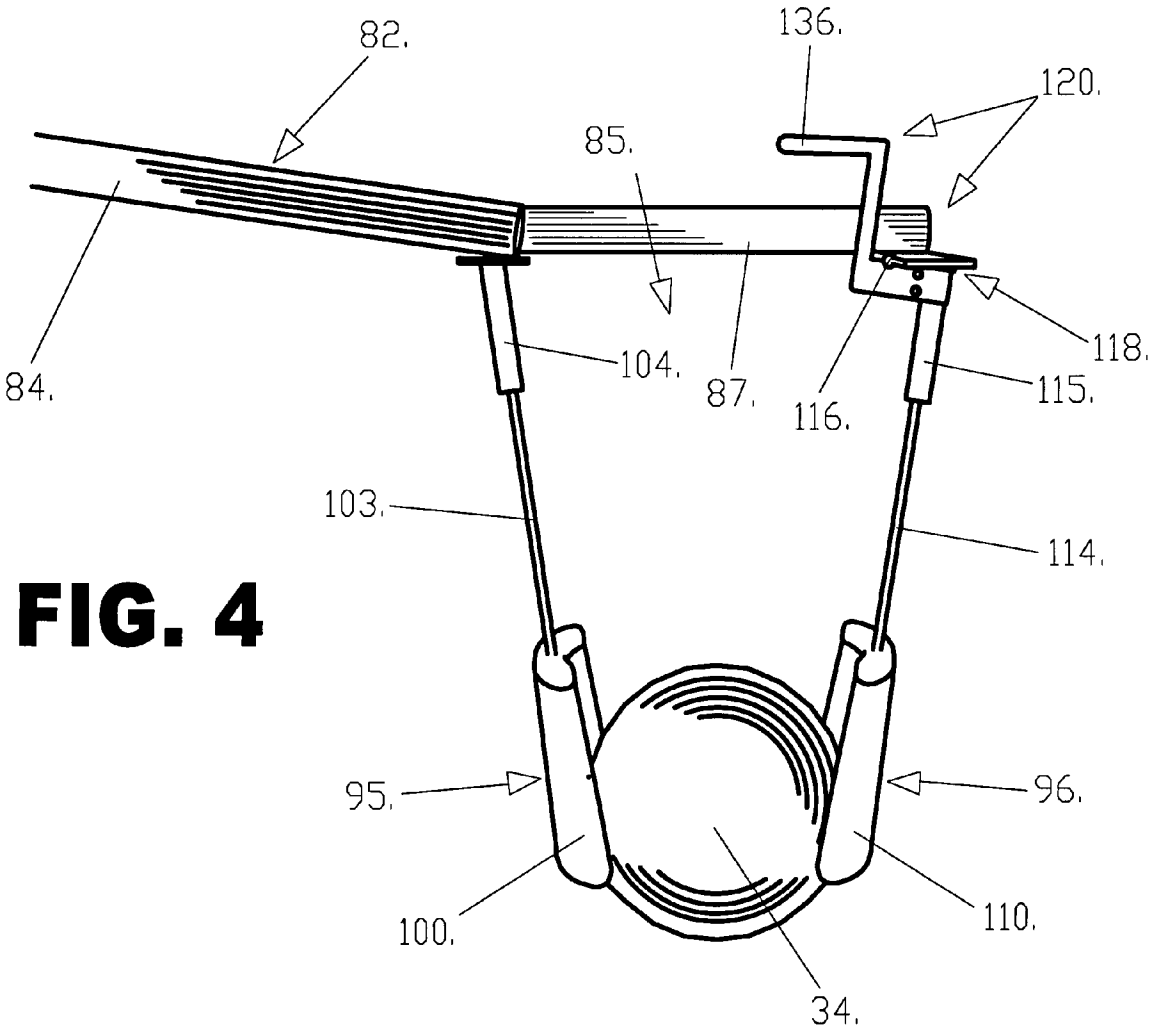
FIG. 4 is an enlarged, fragmentary, isometric view of the preferred discharge point similar to FIG. 3, but showing a ball temporarily captivated between the discharge hands.
Figure 5:
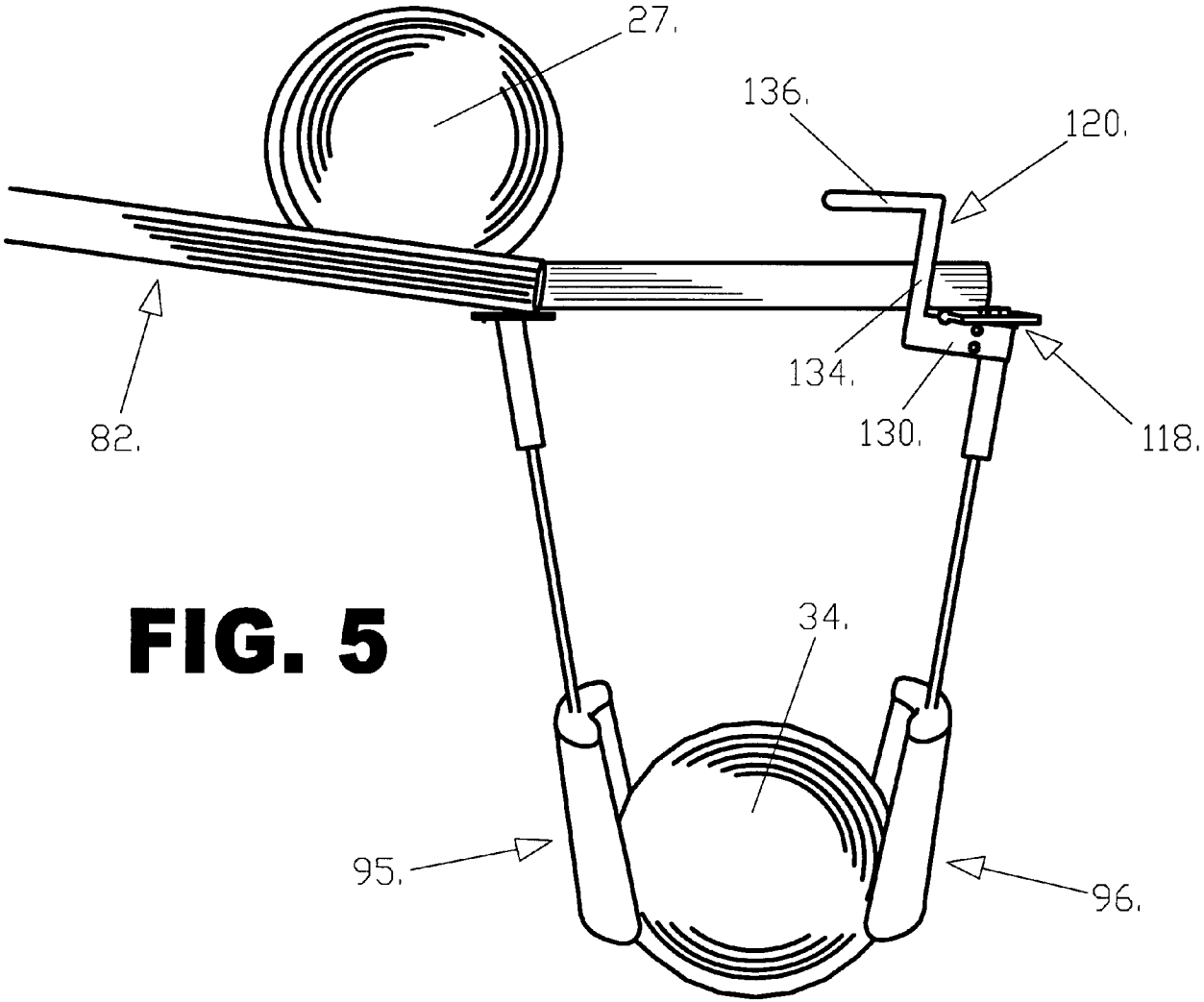
FIG. 5 is an enlarged, fragmentary, isometric view of the preferred discharge point similar to FIGS. 3 and 4, but showing a ball to be spiked captivated between the discharge hands and a second ball rolling down the feed ramp.
Figure 7:
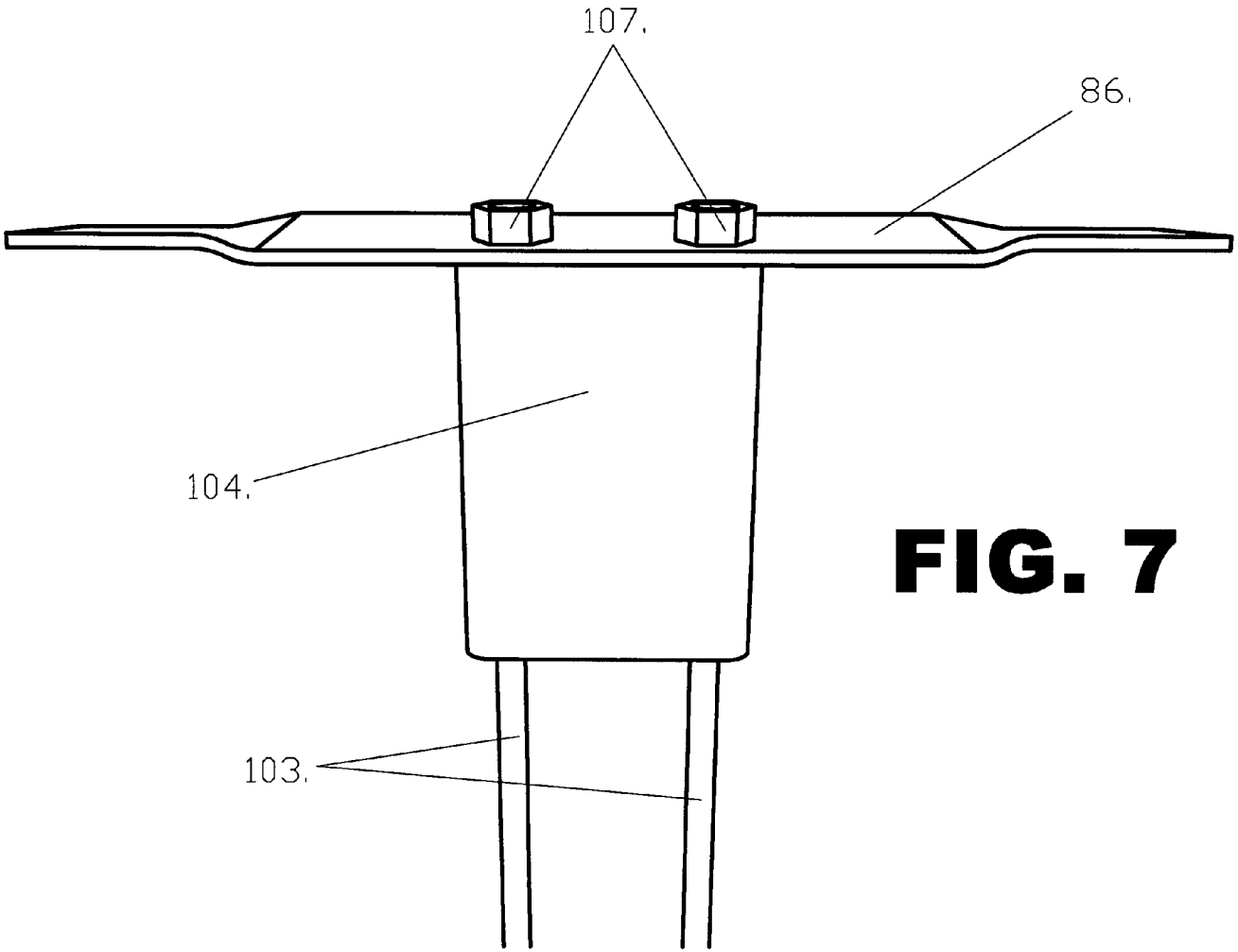
FIG. 7 is an enlarged, fragmentary plan view of a discharge hand showing its mounting, with portions thereof omitted for brevity.
Figure 8:
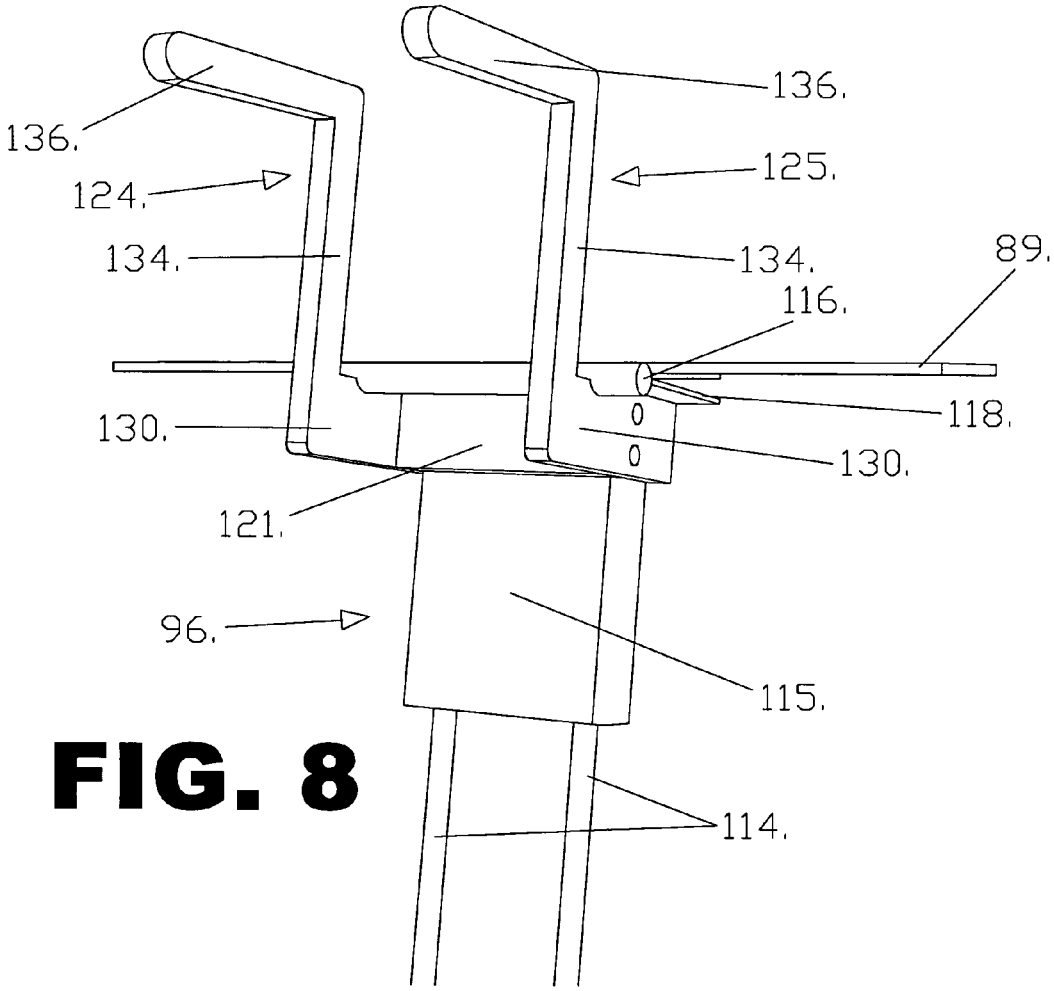
FIG. 8 is an enlarged, frontal fragmentary isometric view of the flexible discharge hand and the preferred indexing levers, with portions thereof omitted for brevity.
Figure 9:
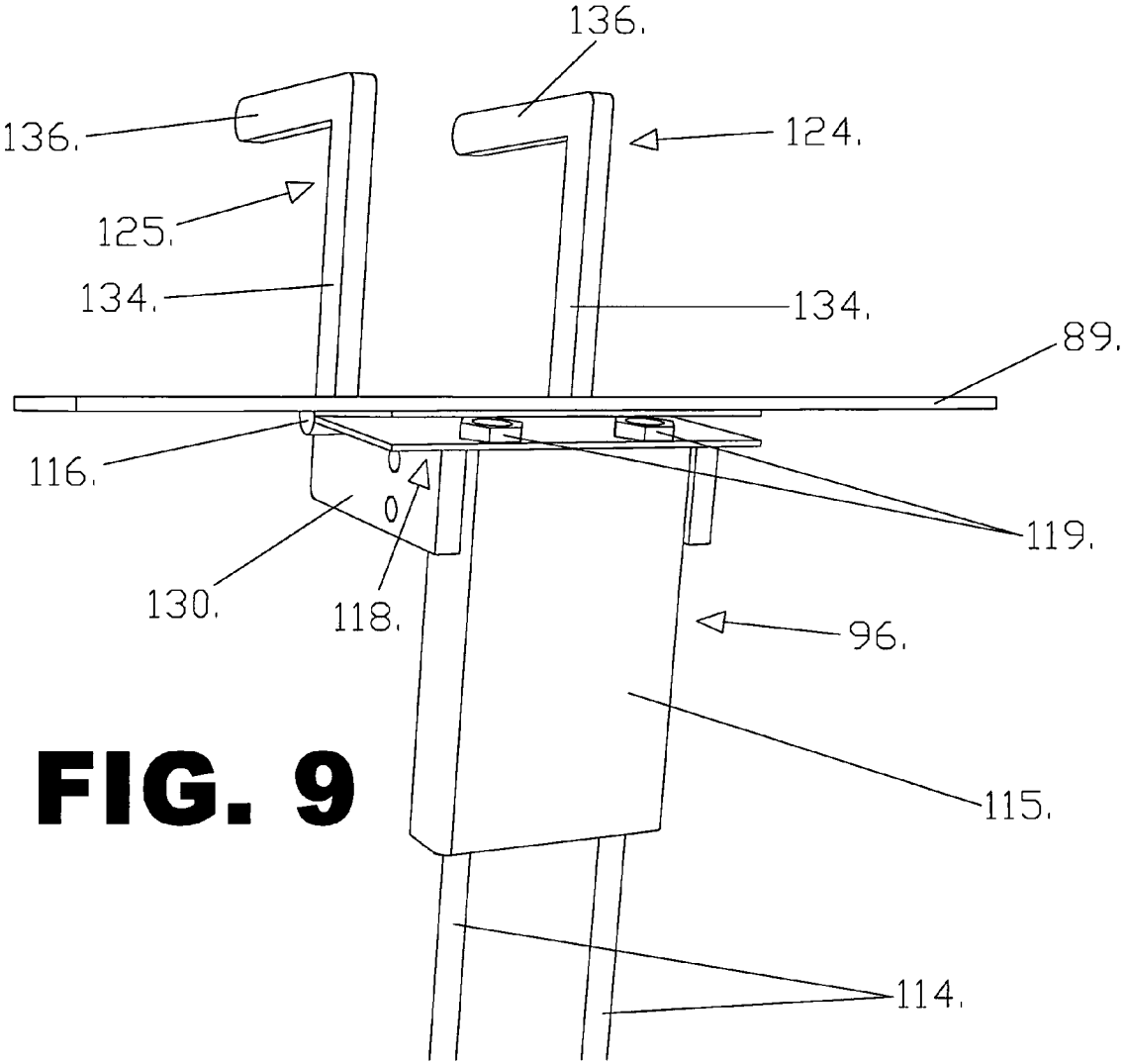
FIG. 9 is an enlarged, fragmentary rear isometric view of the flexible discharge hand and the preferred indexing levers as they appear when a ball is captivated between the hands, with portions thereof omitted for brevity.
Figure 10:
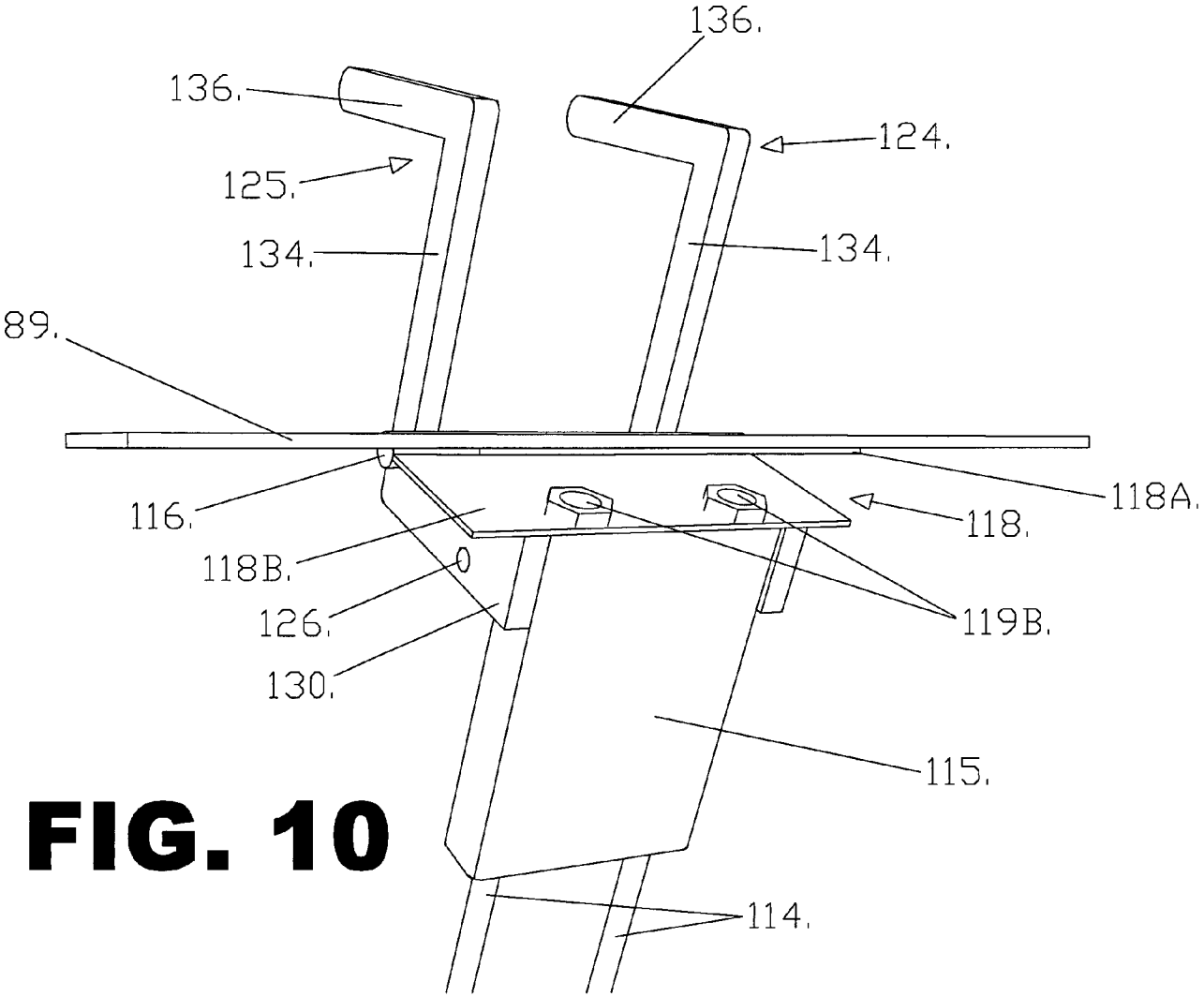
FIG. 10 is an enlarged, fragmentary rear isometric view of the flexible discharge hand and the preferred indexing levers as they appear when a ball is ready to be dropped towards the hands, with portions thereof omitted for brevity.
Figure 14:
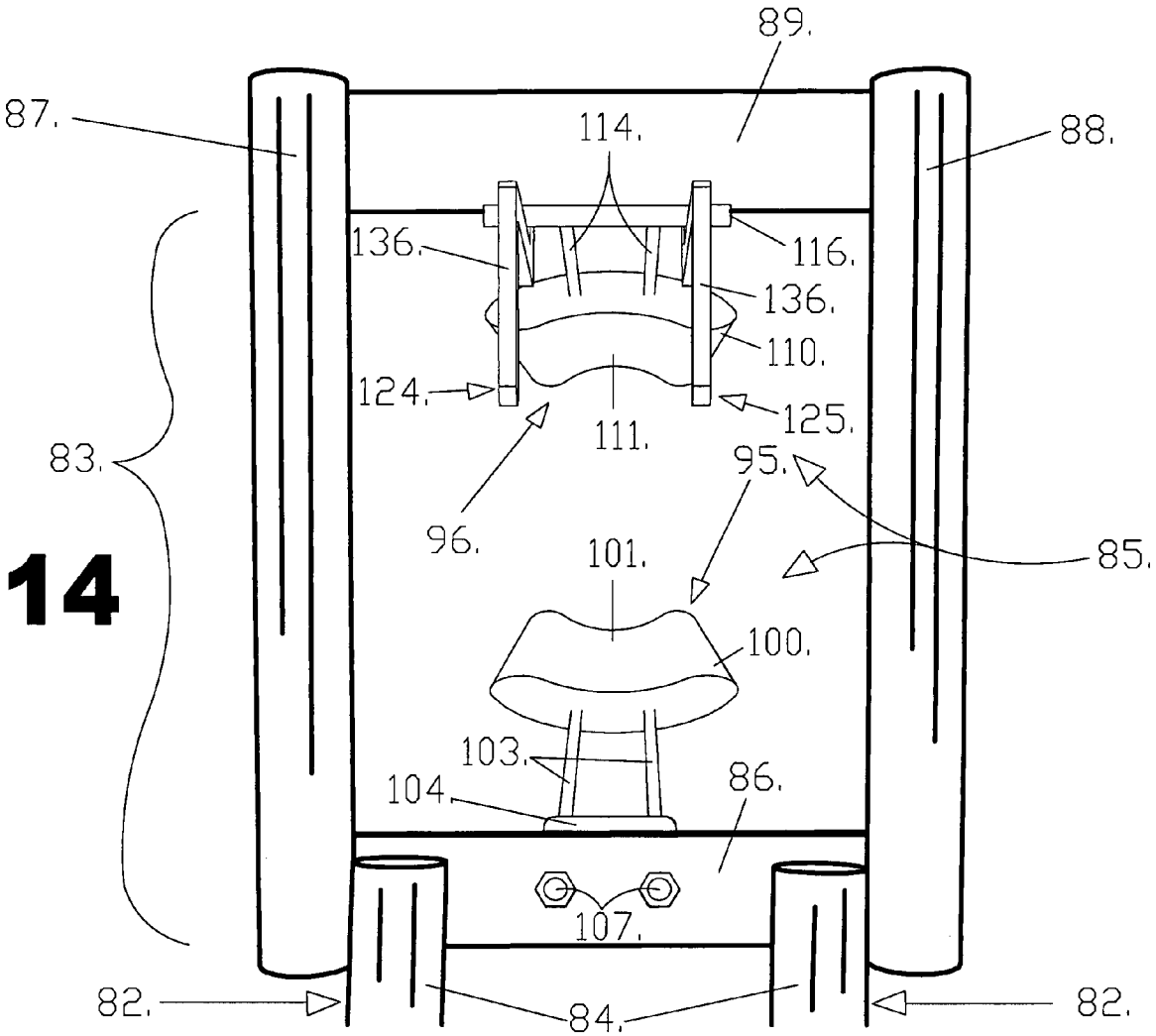
FIG. 14 is an enlarged, fragmentary top plan view of the feed throat region and the discharge hands.
Figure 15:
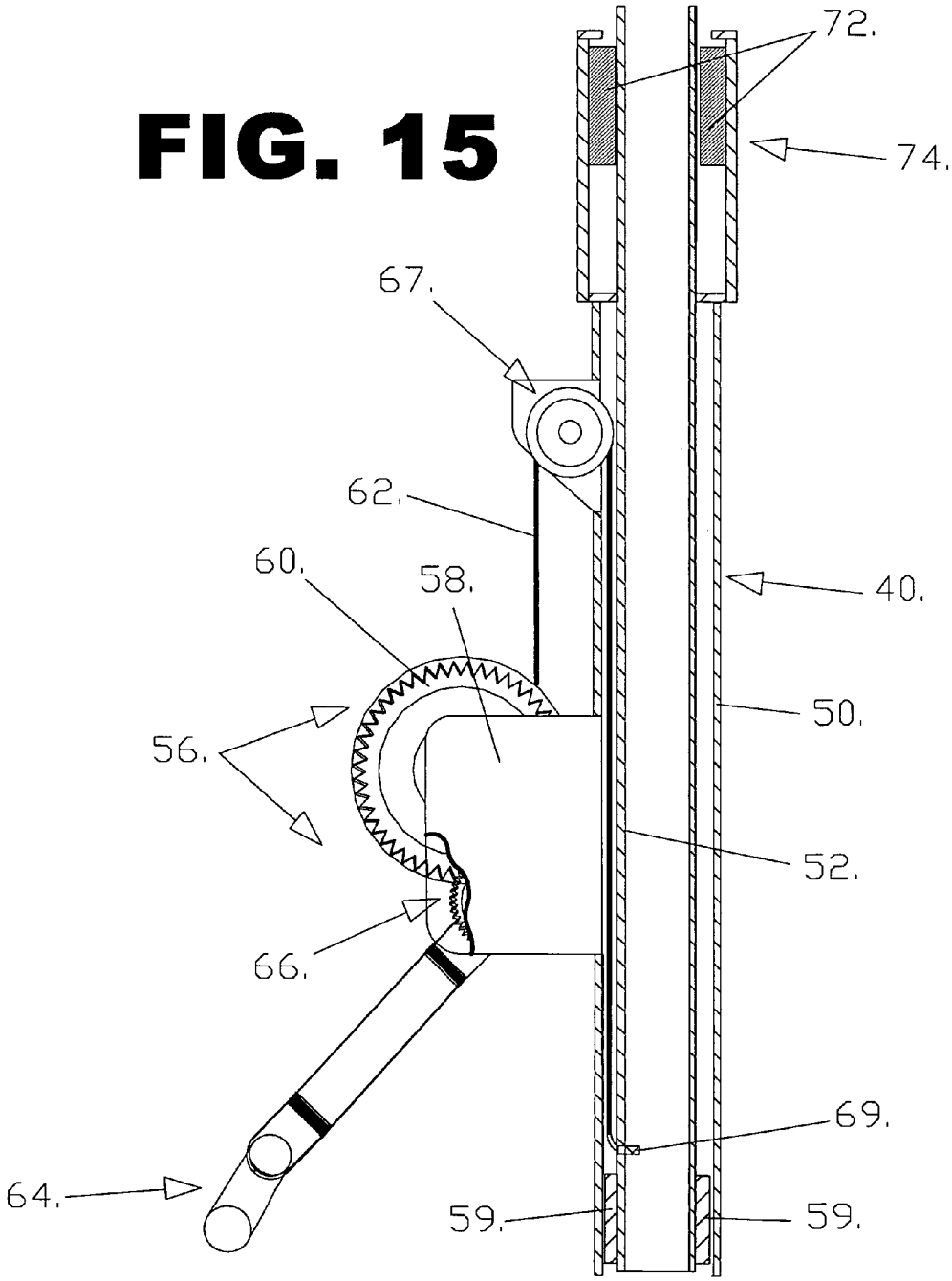
FIG. 15 is an enlarged, fragmentary sectional view showing telescoped portions of the preferred vertically adjustable stanchion.
Figure 16:
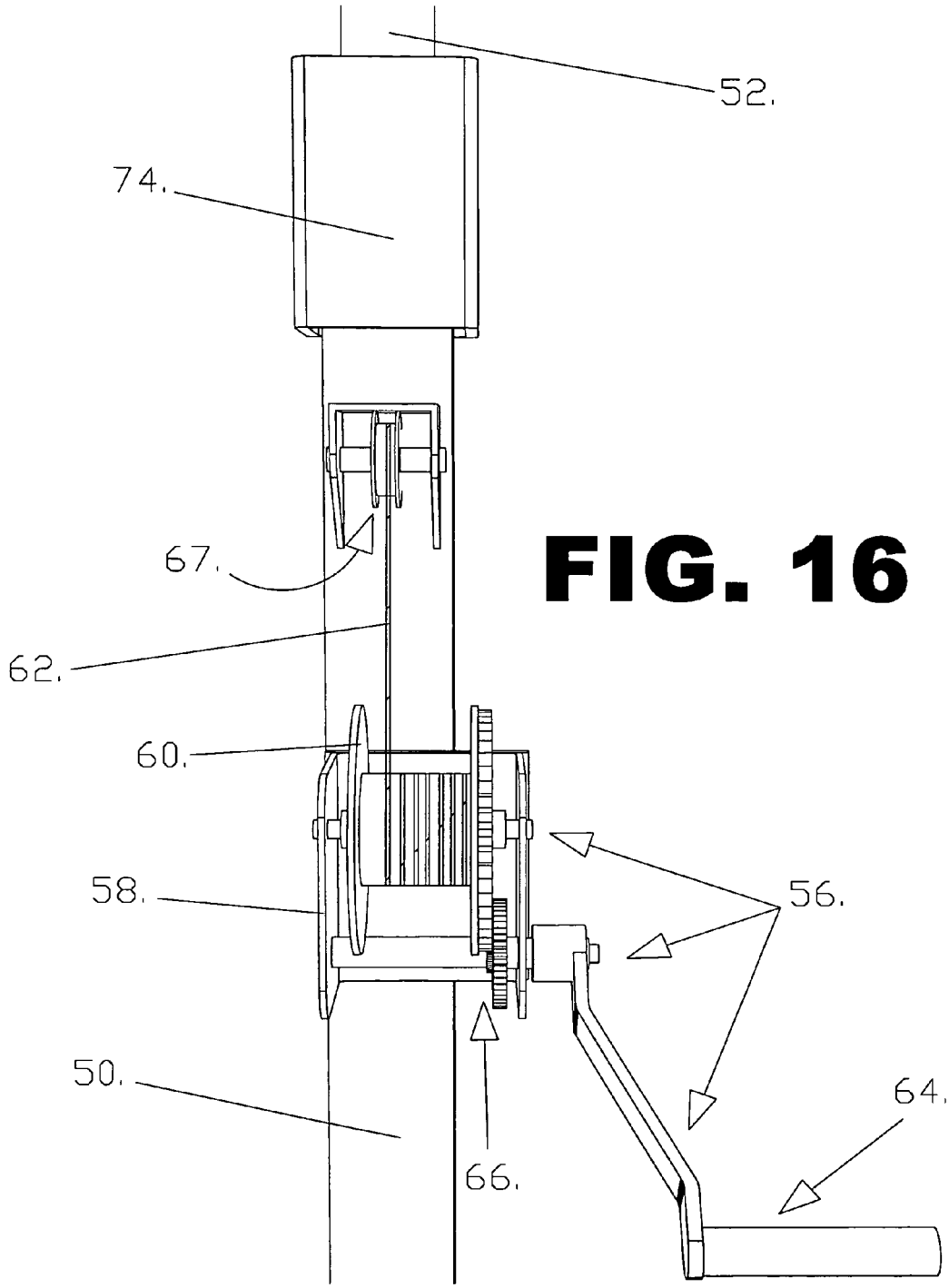
FIG. 16 is a fragmentary plan view of the vertically adjustable stanchion, taken from a position generally to the left of FIG. 8.

With primary reference now directed to FIGS. 1, 2, and 14, the preferred feeding apparatus has been generally designated by the reference numeral 80. An elongated, inclined ball feeding ramp 82 receives balls dropped from hopper 36 through hopper output passageway 37 (FIG. 2). Hopper 36 comprises upwardly outwardly flared sidewalls 37A, 37B FIG. 2). The ball feeding ramp comprises a pair of spaced apart and parallel rails 84 (FIG. 4) extending from the uppermost point of the ramp below hopper 36 (i.e., at the left side of FIG. 2) to a spaced-apart, lower point proximate a discharge throat 85 (i.e., at the right side of FIG. 2). Ramp rails 84 terminate in a discharge subframe 83 (FIG. 14) comprising a crosspiece 86 secured between subframe sides 87 and 88 that are braced by crosspiece 89 (FIG. 7). The ball discharge throat 85 is bounded by and between sides 87 and 88 and crosspieces 86 and 89. Balls drop downwardly through hopper output passageway 37 and serially traverse the inclined ramp 82, traveling from left to right (as viewed in FIG. 2) by gravity. The indexing lever system described later allows balls to drop one-at-a-time through the discharge throat, where they fall into contact between the hands.

The discharge hands 95 and 96 are best understood by reference to FIGS. 1-13. In FIG. 1, a ball 34 that is to be spiked is shown temporarily held between hands 95 and 96. Balls 27 (FIG. 2) travelling down the ramp 82 drop from ramp rails 84 (FIG. 7) towards the discharge throat 85, where they may be either blocked or passed by the indexing system described hereinafter. Balls permitted to travel through discharge throat 85 by the indexing system will drop downwardly into contact between hands 95 and 96. Dropping balls are restrained within and between hands 95 and 96, as illustrated by ball 34 in FIG. 2, where they are releasably and temporarily held for a practice spike.

In the best mode, hand 95 is fixed, and hand 96 is pivotally displaceable. Fixed hand 95 comprises a resilient, preferably plastic cradle 100 with a central channel 101, the shape of which aids in grasping a volleyball. In the best mode the cradles that are shaped to cradle the ball, and are preferably made of foam or any pliable material that can retain shape. Cradle 100 is held by a pair of downwardly angled struts 103 (i.e., FIG. 4) projecting from a mounting block 104 that is secured to crosspiece 86 by nut and bolt fasteners 107 (i.e., FIG. 14). As seen best in FIG. 14, the resilient hand strut 103 is secured to a mounting block 104 that is secured to throat struts 86 by nut-and-bolt fasteners 107. Block 104 is generally in the form of a parallelepiped, and is preferably comprises a solid block of plastic. Alternatively block 104 could be made of wood or metal.

Figure 11:
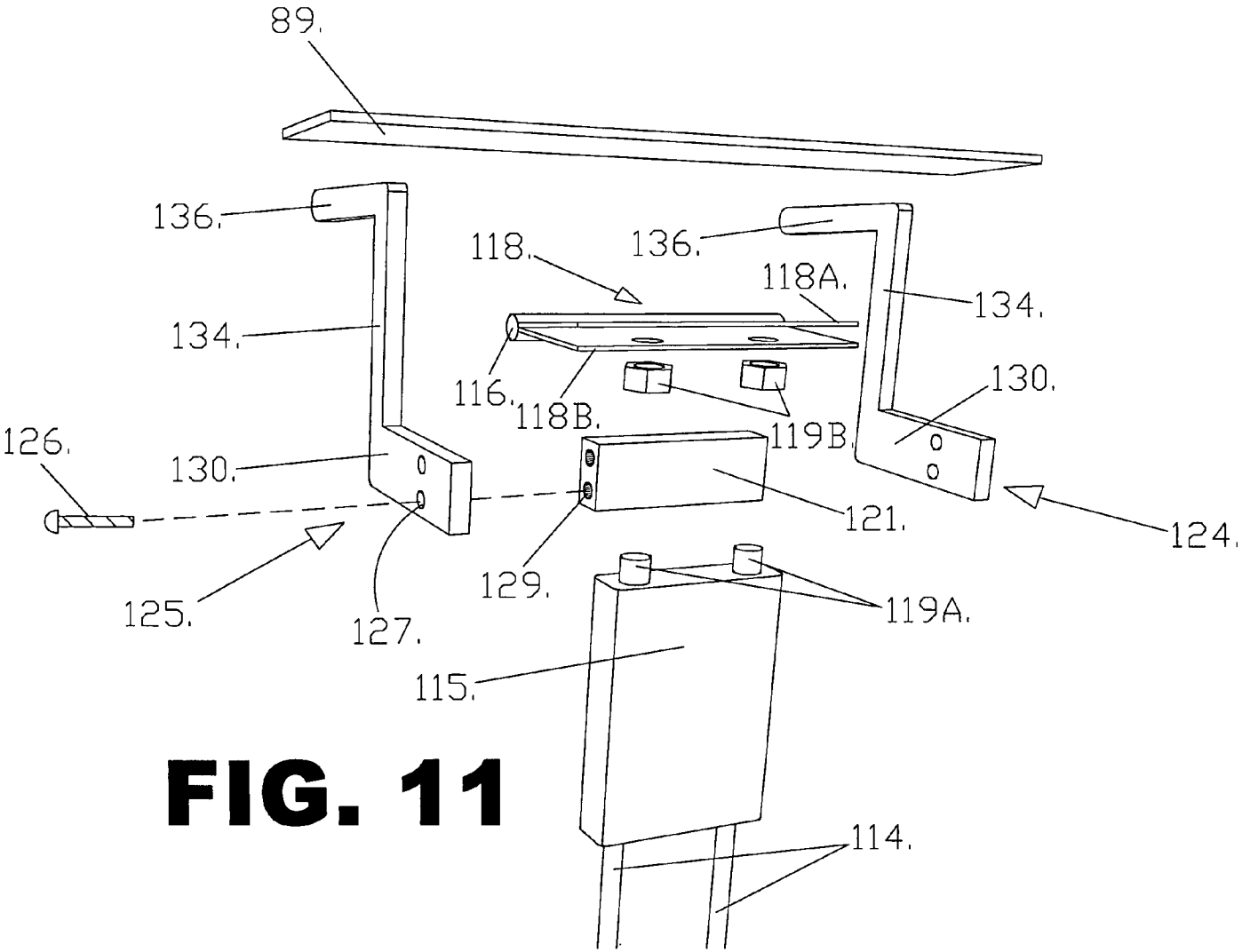
FIG. 11 is an exploded isometric assembly view of the indexing levers and flexible discharge hand.

Similarly, displaceable hand 96 (FIG. 7) has a resilient, preferably foam cradle 110 similar to cradle 100. There is a central channel 111 that is similar to channel 101 (i.e., FIG. 14). Struts 114, similar to struts 103 discussed above, extend from a mounting block 115 that is similar to block 104 discussed above. Block 115 secures movable hand 96 and its cradle 110 to a hinge 118 (i.e., FIGS. 9-11). Hinge 118 has an upper leaf 118A welded to discharge strut 89 proximate the discharge throat 85, and a lower leaf 118B to which block 115 is attached by nuts 119B that threadably mate to studs 119A (FIG. 11). The hinge pivot axis 116 is formed between leaves 118A and 118B. Block 115 is similar to block 104 discussed above. The upper leaf 118A of hinge 118 is fastened beneath discharge throat crosspiece 89 (FIGS. 8-10), preferably by welding. Preferably there is a weight 121 disposed beneath the hinge (FIGS. 8 and 11-13) that operates the indexing lever system explained below in response to gravity.

Figure 6:
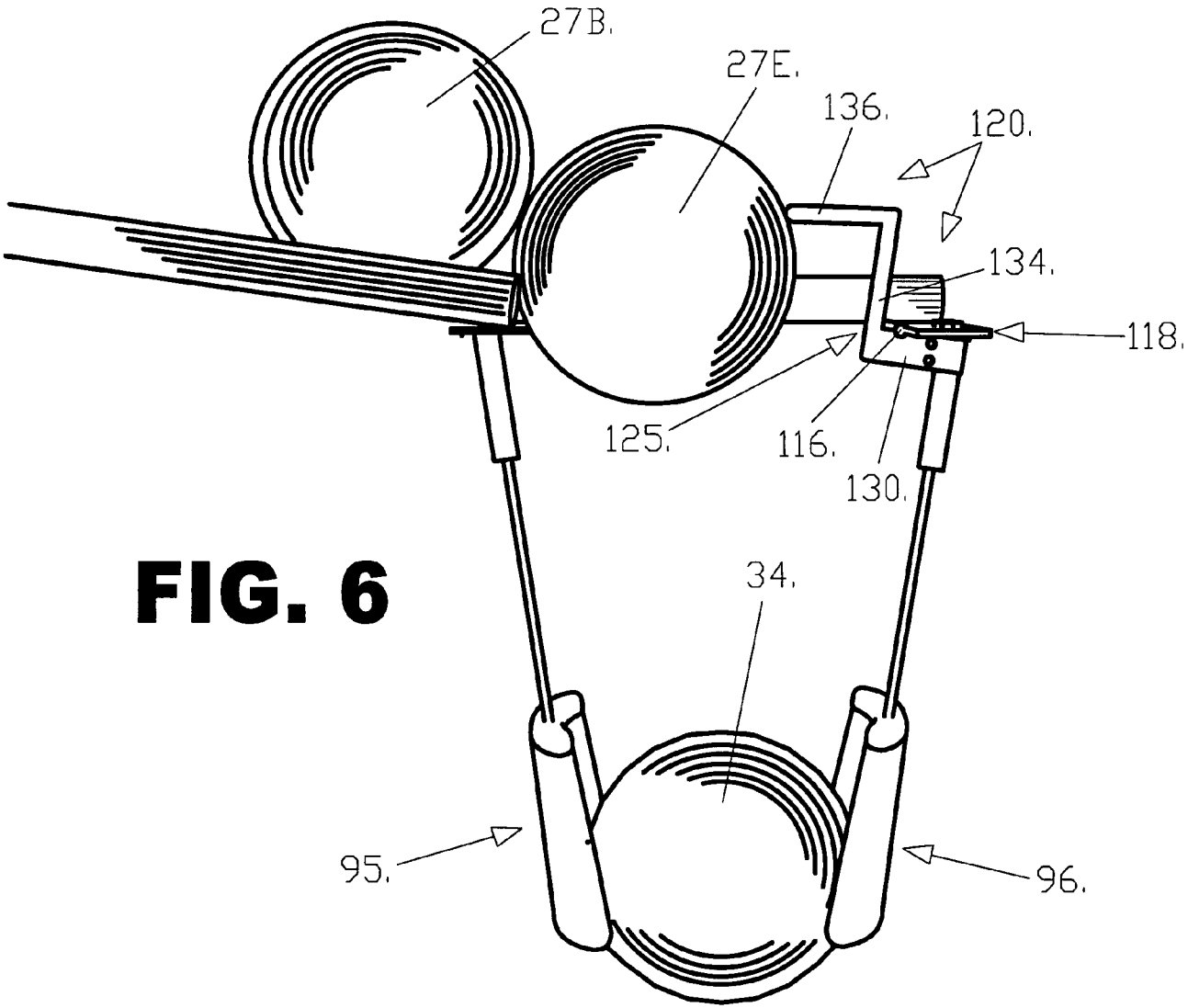
FIG. 6 is an enlarged, fragmentary, isometric view of the preferred discharge point similar to FIGS. 3-5, additionally showing a ball temporarily restrained within the feed throat by the indexing lever.

The moving hand 96 automatically drops to a ball receptive orientation (FIG. 3) by gravity when there is a ball formerly held between hands 95, 96 is shot or dislodged. Weight 121 moves hand 96 towards the fixed hand 95 for reloading. When a ball thereafter drops through the discharge throat 85 (i.e., FIG. 7) and falls downwardly into contact between hands 95 and 96, hand 96 is pivotally displaced towards the right (as viewed in FIG. 4) with the ball 34 being restrained and captivated between the resilient cradles 100, 110. Ball contact however, move hand 96. Travel of the displaceable hand 96 is limited by contact of the nuts 119B (FIG. 12) with upper leaf 118A of hinge 118 discussed earlier. The preferred critical indexing structure will prevent a ball 27 (FIG. 6) rolling down the ramp 82 from traversing the discharge throat 85 when the practice device 22 is already "loaded"—i.e., when there already is a ball 34 to be shot held between hands 95 and 96 (FIG. 6).

There is a generally Z-shaped lever indexing system 120 is mounted above displaceable hand 96. The automatic lever indexing system 120 comprises a pair of similar, preferably aluminum, Z-shaped levers 124, 125 disposed upon opposite sides of the hinge 118. The Z-shape is employed in the best mode, but other shapes (i.e., S-shaped) may be used.

Figure 12:
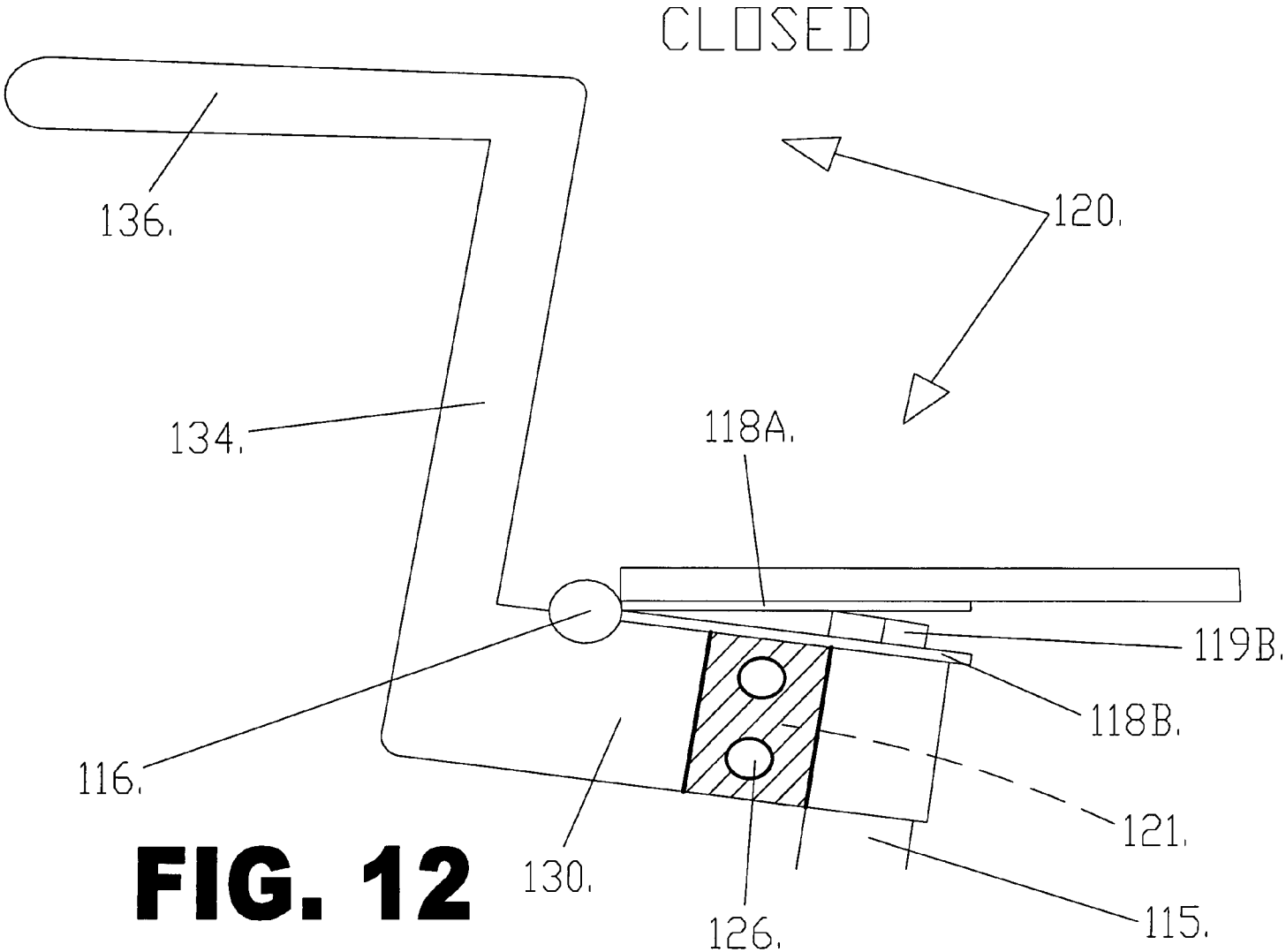
FIG. 12 is fragmentary plan view of a preferred indexing lever, showing it in a closed position to block a ball, with portions shown in section for clarity or omitted for brevity.
Figure 13:
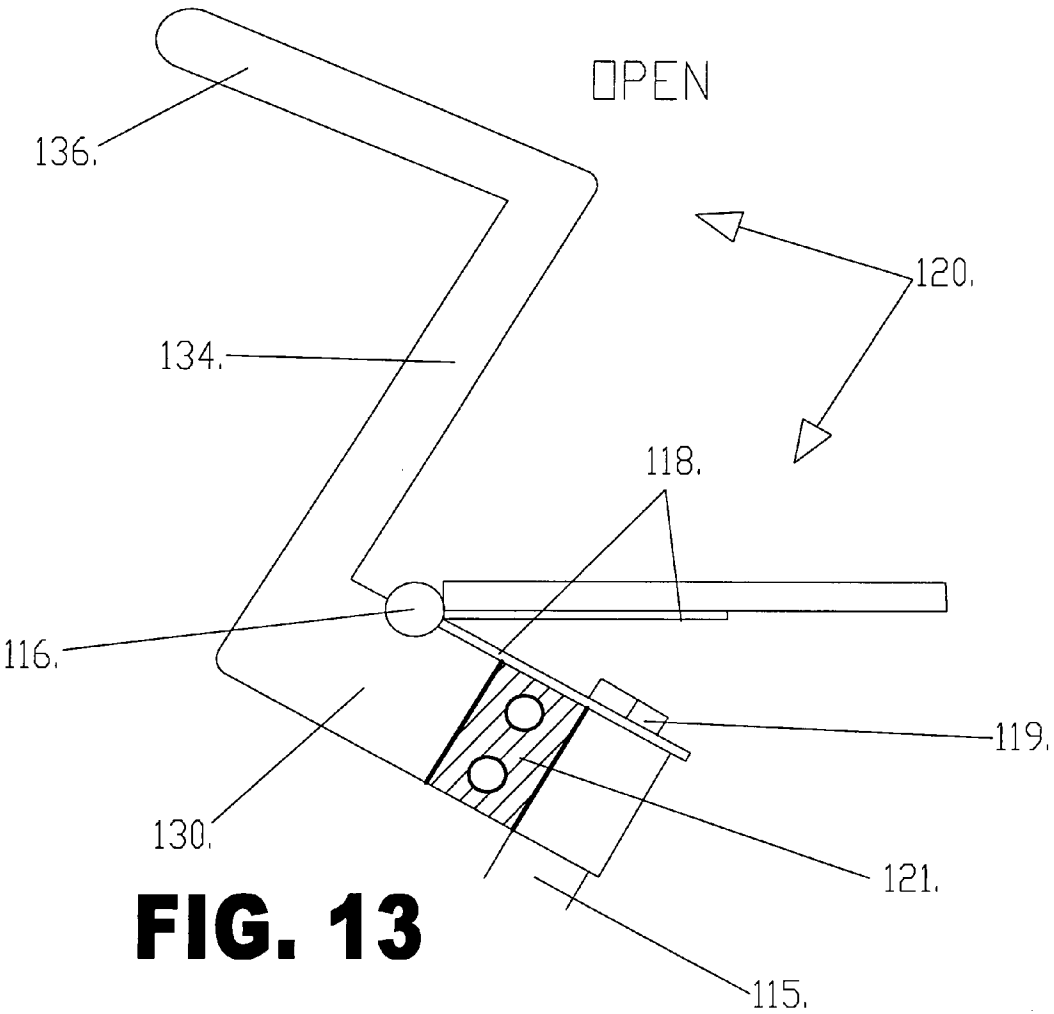
FIG. 13 is fragmentary plan view of a preferred indexing lever, showing it in an open position to feed a ball, with portions shown in section for clarity or omitted for brevity.

As viewed in FIGS. 11-13, each indexing lever preferably has three portions, comprising a lower portion, an upper portion, and an intermediate portion joining the upper and lower portions. In the best mode the lowermost horizontal segment 130 of each preferably Z-shaped lever is affixed at the underside of hinge leaf 118A, sandwiching hand-mounting block 121 therebetween. The rectangular weight 121 is threadably connected between opposing lever segments 130 (FIG. 11) by fasteners 126 extending through orifices 127 in lever segments 130, that threadably seat in threaded block orifices 129. In FIG. 12 it will be observed that weight 121 is positioned between the hinge pivot point 116 and the fastener nut 119B. It will also be observed that the thickness of fastener nuts 119B limit pivoting by contacting the upper lead 118A of the hinge, and thus nut size is important for proper operation.

Each lower horizontal index lever segment 130 is integral with a vertical segment 134 and an upper, generally horizontal segment 136. Proper ball contact is enhanced by proper spacing of the two Z-shaped indexing levers. When hands 95 and 96, and thus cradles 100, 110, contact and center a loaded ball being restrained, the upper segments 136 of the indexing levers point towards and contact and restrain a ball 27E (FIG. 6) that is waiting its turn to drop through the discharge slot 85. The Z-shaped levers are thus deflected to block another incoming ball when a ball to be spiked is secured between the hands.

Figure 3:
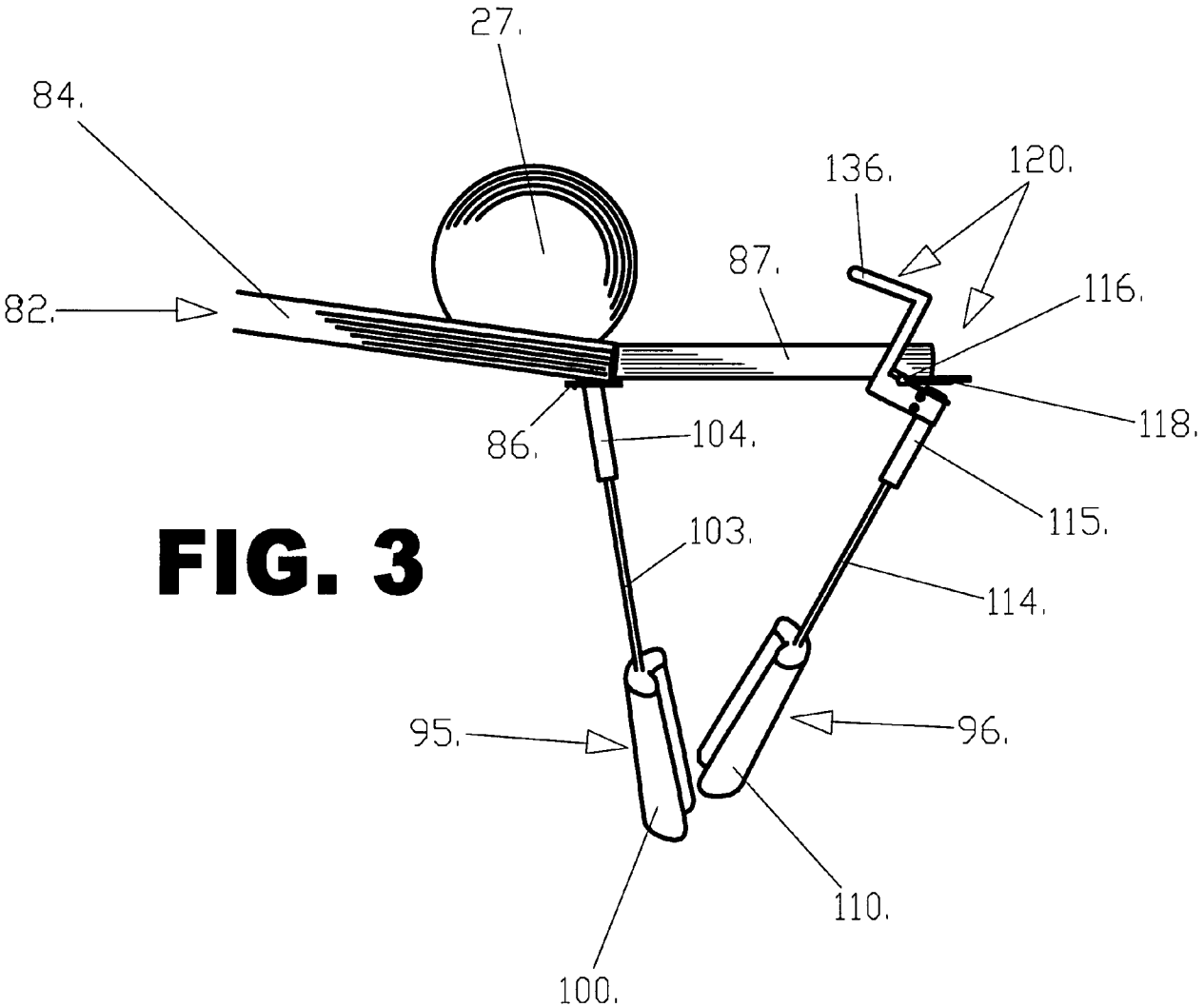
FIG. 3 is a further enlarged, fragmentary, isometric view of the preferred feeding apparatus discharge point, showing a ball travelling towards the feed throat.

Hand 96 drops by gravity to the position of FIG. 3 after a shot in response to the weight 121 (FIG. 11). In the latter position, it will be observed that lever segment 136 is maximally spaced apart from a ball 27 travelling down the ramp 82. However, after spiking, when a replacement ball drops through the discharge throat 85, it contacts the hands 95, 96, displacing hand 96 towards the right (as viewed in FIG. 6), moving the indexing lever system into contact with a subsequent ball 27E (FIG. 6) that is blocked from further travel until released by the lever segments 136 pushing towards it. When ball 34 (FIG. 6) for example, is discharged by a hit or spike, lever segments 136 will pivot away from ball 27E which will drop between hands 95, and 96 again pivoting the index levers 124, 125 so that ball 27B will be restrained and ball 27E (FIG. 6) will be dropped into a loaded position. Weighted mounting block 121 assists hand 96 to fall into the open position shown in FIGS. 3, 10, and 13). Alternatively a spring or counter weight could be used to assist hand 96 to be moved into the open position.

Figure 17:
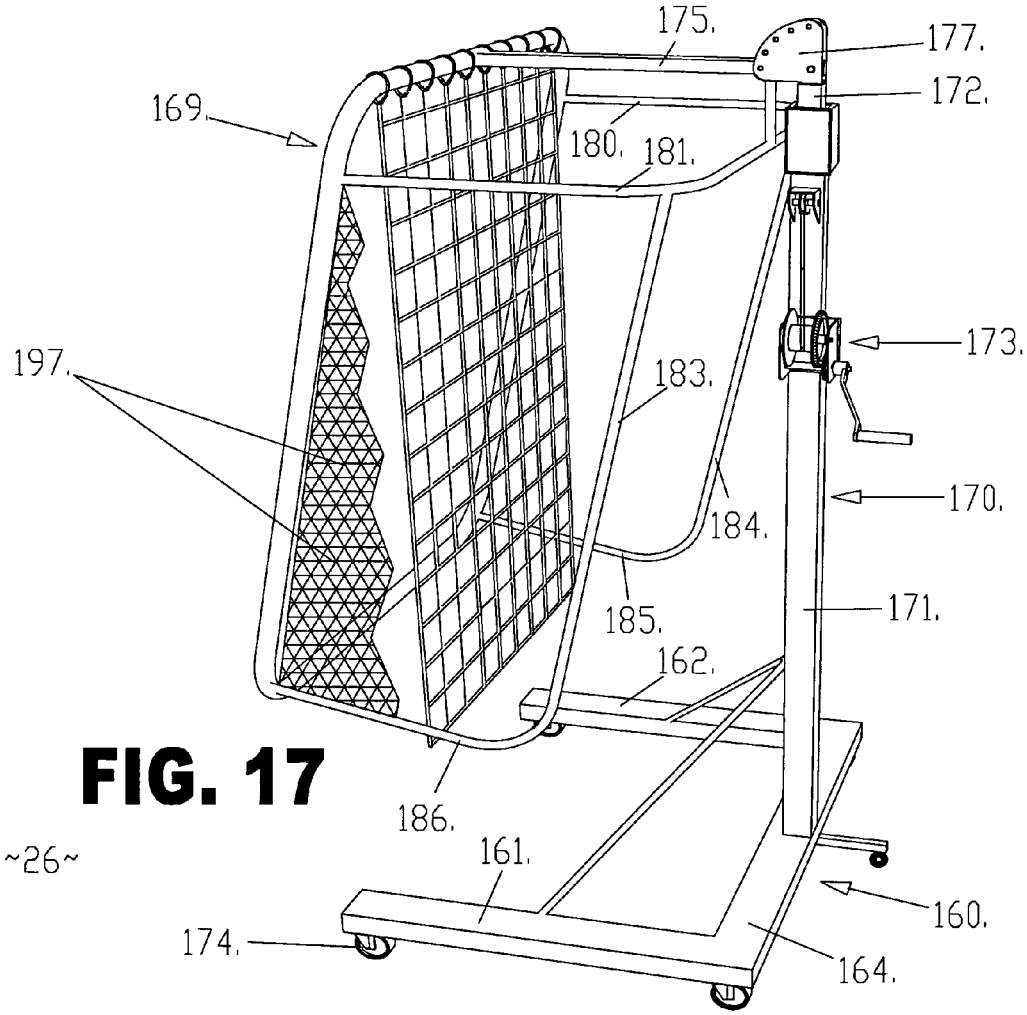
FIG. 17 is a fragmentary rear isometric view of the preferred auxiliary target net for collecting properly aimed, spiked balls; and, FIG. 18 is an enlarged, fragmentary frontal isometric view of the preferred auxiliary target net.
Figure 18:
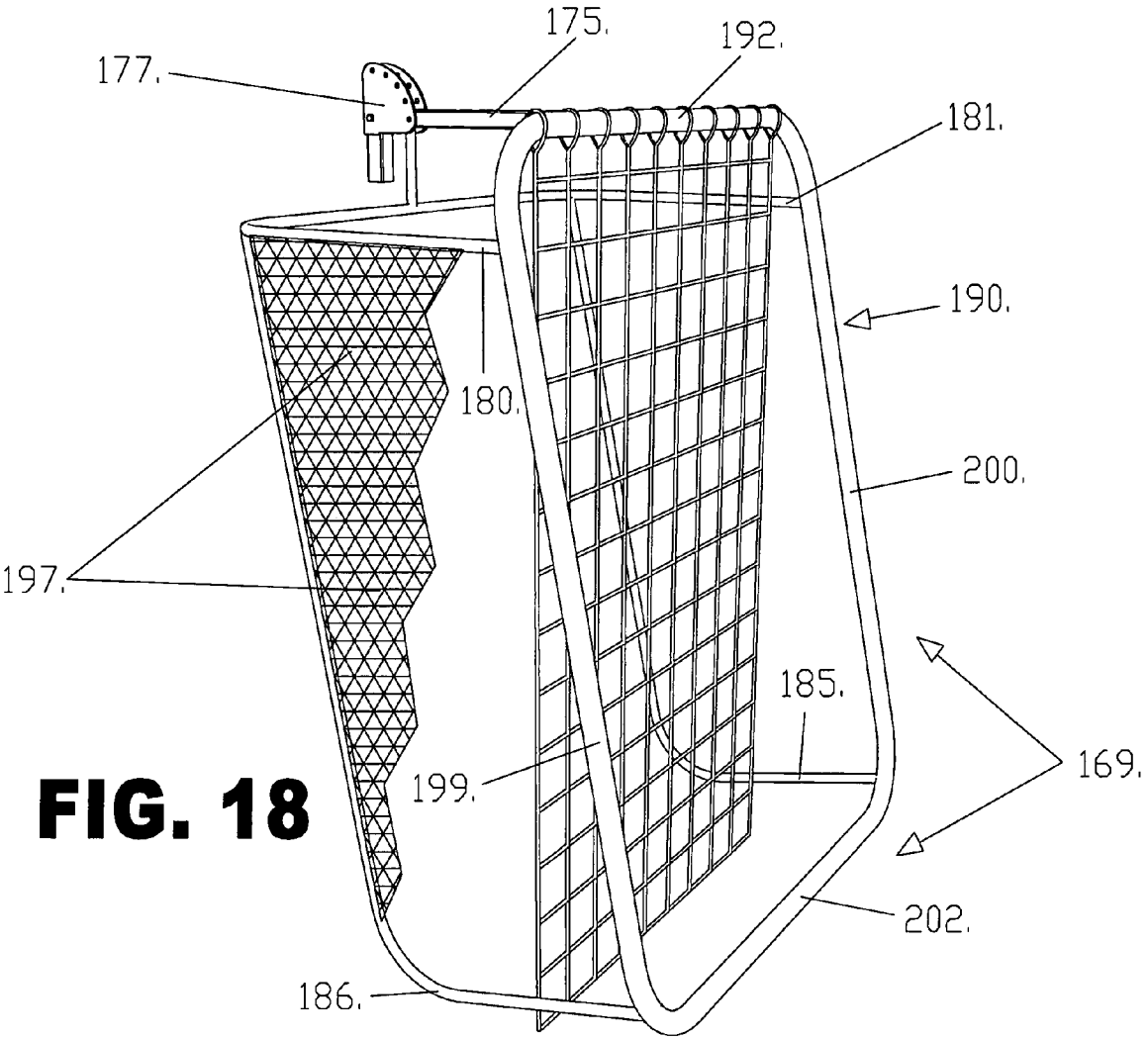

The optional or auxiliary target training net assembly 24 is best illustrated in FIGS. 17 and 18. Net assembly 24 comprises a rigid, lower, generally C-shaped chassis 160 comprising a pair of forwardly projecting legs 161, 162 secured at their rear by a transverse strut 164. A vertically oriented stanchion 170 that supports the net 169 is secured to strut 164. Stanchion 170 is extensible and adjustable, comprising a fixed base section 171 in which upper, displaceable section 172 is telescoped. A handle assembly 173 adjusts stanchion 170 in the same manner discussed previously in conjunction with FIGS. 8 and 9. Caster wheels 174 are provided for mobility.

The net 169 is held by a strut 175 projecting at a selected angle from between sides of a guide bracket 177 that allows the selection of varying angles. A net subframe is formed by spaced horizontal struts 180 and 181, vertical struts 183, 184 and lower horizontal segments 185, 186. A rigid, generally rectangular frame 190 (FIG. 18) is disposed at the net front, being held by struts 180-185. The upper horizontal segment of frame 190 supports frontal webbed netting 194 that hangs down generally perpendicularly to the playing surface 26. Peripheral netting 197 is arrayed to the sides of netting 194, being suspended between frame sides 199, 200 and the struts 180, 181, 185 and 186 described earlier (FIG. 17). Struts 185 and 186 are secured to bottom of frame 190, being welded to frame bottom 202 (FIG. 18).

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

What is claimed is:

1. A training device for teaching the spiking of balls, the device comprising:

a chassis adapted to be disposed upon a playing surface;

a support stanchion extending vertically upwardly from said chassis;

a hopper for receiving balls, the hopper supported by said stanchion and comprising a ball output passageway;

a ball discharge throat spaced apart from said hopper;

an inclined feeding ramp for receiving balls from said hopper and guiding them towards said discharge throat;

a pair of hands for temporarily holding balls dropping through said discharge throat until the ball is stricken; and, an automatic indexing system for establishing one-at-a-time ball travel through said discharge throat in response to movement of at least one of said hands.

2. The training device of claim 1 wherein at least one hand is pivotally displaceable.

3. The training device of claim 2 wherein the indexing system is moved by said displaceable hand when a ball is loaded for spiking.

4. The training device of claim 2 wherein said indexing system moves to a ball restraining position preventing balls from passing through said throat when a ball to be spiked is positioned between said hands.

5. The training device of claim 4 wherein said indexing system comprises a weight for automatically moving the indexing system to allow a subsequent ball to drop through said throat after a spike, and wherein movement of said indexing system moves said displaceable hand.

6. The training device of claim 4 wherein said indexing system comprises at least one pivoted Z-shaped lever mechanically coupled to said displaceable hand.

7. The training device of claim 6 wherein each Z-shaped indexing lever comprises a bottom segment to which said displaceable hand is mounted, an integral intermediate segment, and an integral, upper segment projecting towards said throat from said intermediate segment for contacting balls.

8. The training device of claim 5 wherein said indexing system is secured to a hinge proximate said throat.

9. The training device of claim 1 wherein said stanchion comprises a telescoping section, and the device comprises a rotatable crank for adjusting the length of said stanchion.

10. A volleyball training device for teaching the spiking of balls, the device comprising:

a chassis adapted to be disposed upon a playing surface;

an adjustable support stanchion extending vertically upwardly from said chassis;

a hopper for receiving balls, the hopper supported by said stanchion and comprising a ball output passageway;

an inclined feeding ramp for receiving balls from said hopper output passageway; a ball discharge throat spaced apart from said hopper towards which balls on said ramp move;

a pair of hands for temporarily holding balls dropping through said discharge throat until the ball is stricken, wherein at least one hand is pivotally displaceable; and, an automatic indexing system for establishing one-at-a-time ball travel through said discharge throat in response to movement of at least one of said hands.

11. The training device of claim 10 wherein the indexing system is moved by said displaceable hand when a ball is loaded for spiking towards a position to block a subsequent ball from dropping through said discharge throat.

12. The training device of claim 11 wherein said indexing system comprises a weight for automatically moving the indexing system out of the way to allow a subsequent ball on said ramp to drop through said throat after a spike, and wherein said movement of said indexing system moves said displaceable hand.

13. The training device of claim 12 wherein said indexing system comprises at least one pivoted Z-shaped lever mechanically coupled to said displaceable hand.

14. The training device of claim 12 wherein the indexing system comprises at least one indexing lever comprising a bottom segment to which said displaceable hand is mounted, an integral intermediate segment, and an integral, upper segment projecting towards said throat from said intermediate segment for contacting balls.

15. The training device of claim 14 wherein said indexing system is secured to a hinge proximate said throat.

16. A volleyball training device for teaching the spiking of balls, the device comprising:

a chassis adapted to be disposed upon a playing surface;

an adjustable support stanchion extending vertically upwardly from said chassis;

a hopper for receiving balls, the hopper supported by said stanchion and comprising a ball output passageway;

an inclined feeding ramp for receiving balls from said hopper output passageway; a ball discharge throat spaced apart from said hopper towards which balls on said ramp move;

a pair of hands for temporarily holding balls dropping through said discharge throat until the ball is stricken, wherein at least one hand is pivotally displaceable; and, an automatic indexing system for establishing one-at-a-time ball travel through said discharge throat in response to movement of at least one of said hands, the indexing system comprising at least one indexing lever comprising a bottom segment to which said displaceable hand is mounted, an integral intermediate segment, and an integral, upper segment projecting towards said throat from said intermediate segment for contacting balls.

17. The training device of claim 16 wherein the indexing system is moved by said displaceable hand when a ball is loaded for spiking towards a position to block a subsequent ball from dropping through said discharge throat, and wherein said indexing system comprises a weight for automatically moving the indexing system out of the way to allow a subsequent ball on said ramp to drop through said throat after a spike, and wherein said last mentioned movement of said indexing system moves said displaceable hand.

18. The training device of claim 17 wherein said indexing system is secured to a hinge proximate said throat.

19. The training device of claim 16 wherein said indexing system comprises at least one pivoted Z-shaped lever mechanically coupled to said displaceable hand.

20. The training device of claim 16 wherein said stanchion comprises a telescoping section, and the device comprises a rotatable crank for adjusting the length of said stanchion by moving said telescoping section.

* * * * *